United States Patent [19]

Koltz

[11] 4,360,146

[45] Nov. 23, 1982

[54] OPEN TOP SET UP CONTAINER

[76] Inventor: Irving M. Koltz, 1329 Steeles A, TH4, Willowdale, Ontario, Canada, M2R 3N2

[21] Appl. No.: 179,739

[22] Filed: Aug. 20, 1980

[51] Int. Cl.[3] ..... B65D 5/42

[52] U.S. Cl. ..... 229/24; 229/41 C; 229/41 D

[58] Field of Search ..... 229/24, 41 C, 41 D

[56] References Cited

U.S. PATENT DOCUMENTS

| | | | |
|---|---|---|---|
| 1,555,054 | 9/1925 | Berkowitz | 229/41 C |
| 1,892,715 | 1/1933 | Wellman | 229/41 C |
| 2,165,906 | 7/1939 | Reich | 229/41 C |
| 2,787,408 | 4/1957 | Andre | 229/16 R |
| 2,922,562 | 1/1960 | Pellatan | 229/41 C |
| 3,373,917 | 3/1968 | Cox | 229/41 C |
| 4,284,205 | 8/1981 | Hiratee | 229/41 D |

FOREIGN PATENT DOCUMENTS

| | | | |
|---|---|---|---|
| 505215 | 8/1951 | Belgium | 229/41 C |
| 671914 | 5/1952 | United Kingdom | 229/41 C |

*Primary Examiner*—Herbert F. Ross

[57] ABSTRACT

The invention relates to a blank capable of being rapidly set up into a self-supporting container. The container blank has a polygonal base panel having right sides, at least ten side panels, each of which is separated from at least one other side panel by a fold line. No more than eight of said side panels are separated from the base panel by a fold line which forms a peripheral side of the base member. The side panels are in a first contiguous group and a second contiguous group. Two end members of said side panels are glue flaps. In the blank a first set of the side panels and a second set of the panels, are panels which do not share a fold line with said base panel, and each have a set of support webs sharing a common fold line with each other. Each support web panel shares a fold line with one member of said set of side panels.

24 Claims, 13 Drawing Figures

OPEN TOP SET UP CONTAINER

BACKGROUND OF THE INVENTION

1. Field of the Invention

This invention relates to improvements in a set-up container in bucket style generally of a paperboard type material.

2. Brief Description of the Prior Art

Many containers have been designed attempting to perfect the collapsible bucket style container having a multiplicity of sides, ranging from five to circular.

The octagonal and circular "bucket" configurations have received the most attention and success to date, however, there have been basic compromises. The bucket used to contain food, such as fried chicken or popcorn has generally been of a non-collapsible configuration, allowing for the permanent sealing of the seams at the base and sides to prevent leakage.

The collapsible buckets never gained popularity with food related products because of the obvious problems of strength and sealage.

In U.S. Pat. No. 3,827,623, a collapsible circular container is disclosed. As illustrated in FIGS. 4 and 5, the latching tongue 23 locks into the latching aperature 59 with the bottom panels being folded thereon. The bottom seal of this container does not prevent leakage and can safely be used for dry foods only.

The container of U.S. Pat. No. 2,787,408 appears to overcome the aforenoted problem of leakage, however, the strength of the container is not equal to that of the instant invention. The container is glued to appear much like a paper bag when unopened. To secure the container in the open position, the "lower ends of . . . two walls 14, 15 will snap inwardly toward each other at points 11 . . . ". Although there is a snaping action, there is no locking action to prevent the lower ends of the wall from returning to the unfolded position. This would preclude this container from being used with heavy items such as chicken or the like and could pose some problems with items such as popcorn where there is frequent pressure at the bottom.

U.S. Pat. No. 3,809,310 discloses a hexagonal container which, to complete the bottom seal, requires adhesive coated portions. This adds additional expense to the manufacturing through adhesive and additional equipment. In addition the top portion of the container is required to add to the rigidity of the carton, therefore limiting its uses.

Various other patents have attempted to overcome these difficulties, however none have combined strength, ease of manufacturing, reduced shipping and disposal costs, convenience of opening with the non-leak feature, until the instant invention.

BRIEF DESCRIPTION OF THE DRAWINGS

The objects and advantages will be made clearer when read in conjunction with the drawings wherein.

DETAILED DESCRIPTION OF THE INVENTION

Figure 1:
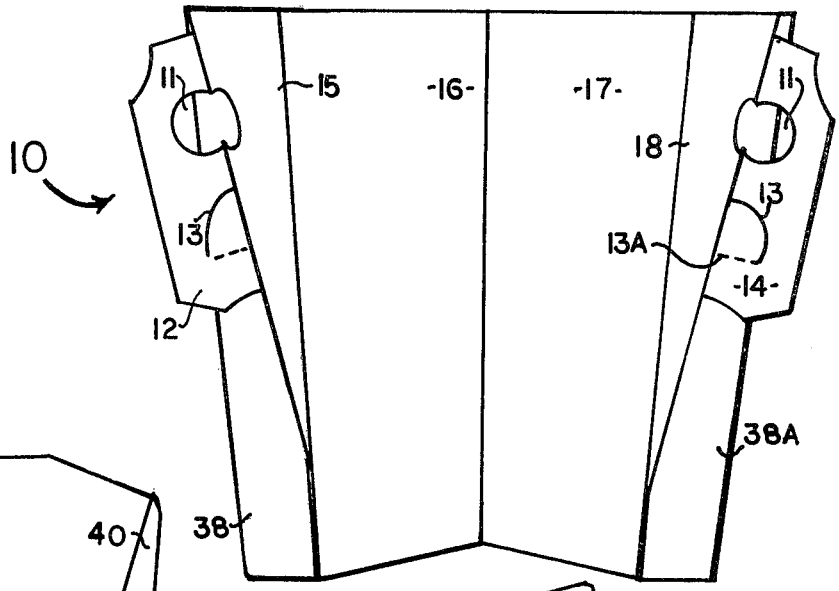
FIG. 1 is a side view of the assembled container.

The structure of the formed container is critical for a variety of reasons. In certain applications, the container must be leak proof, for example, when used as a receptacle for popcorn or similar comodity which is covered with melted butter, vegetable oils or the like, since migration of the fluid outside of the container must be absolutely precluded. The structure is designed to close even minute pinholes and can even be used with non-viscous fluids provided the material of the container is properly selected to achieve fluid impermeability.

The container, in all forms, must be structurally rigid and not collapse in use and must be capable of standing upright on its own base and withstand inadvertent tipping. The structural rigidity of a bucket is to a great extent achieved by providing a rolled top which form a ring like top edge. However, the rolled top adds considerably to the product cost and is in conflict with the ability to be shipped in a flat form.

The structure of the blank is essential because a minimum amount of material must be used to produce the final structure. Thus, although it can be possible to form the same container from a variety of blanks, the blank designs of the instant invention are critical in order to use minimum material without intolerable sacrifice of structural strength, and without necessitating excessively complex assembly. Laborous assembly could render the device either so inconvenient or time consuming to assemble as to render the final product non-competitive, even through it fully meets all other requirements.

As used herein, the term "set up" is intended to mean the step of or procedure for, converting a flat blank to a finished container, where parts of the blank are glued, the term set up presupposes that the blank is in condition for the final assembly, included pregluing or other pretreatment of parts or regions.

The terms crease, fold-line and score-line are used essentially interchangably to designate a conditioning of the material of the blank to permit the blank to readily and sharply fold along a predetermined line without damaging or distorting surrounding regions.

A term such as "folding inwardly" or "infolding" is employed to designate the step of folding material about a scoreline so as to move a region of the material toward the interior of the container so as to form an enfoldment, as compared for example, to a handle, which extends exteriorly of the container.

The term knock-down or folded carton is generally used for containers of the type disclosed herein. It should be noted, however, that the containers main function is to be used in its "set-up" form and is not intended for knock-down to a collapsed form. In fact, in certain forms, the interlocking mechanisms preclude inadvertent as well as intentional knock-down to a flat form. While it is extremely valuable to be able to ship in a flat form, after use collapsing is of value in that it facilitates disposal by requiring less space, but knock-down and later resue is not a prerequisite of the product.

Similarly, the method of setting up the container is critical not merely to the extent that certain steps must be followed to convert the flat blank to an open top set up container, but the steps must be such that the operator can achieve a rapidity of the assemblying operation and a high level of technical skill is not required.

FIG. 1 illustrates the assembled bucket 10 of the instant invention. The handles 12 and 14 are shown herein extending essentially at right angles from the panels 15 and 18. The handles 12 and 14 are provided with cutouts 11 and 13 which provide a more efficient structure on which to grip.

During manufacture, the cutout 11 is perforated in a circular configuration. The perforation does not necessarily have to be in a complete circular shape, but can be anywhere from one quarter to a complete circle. The cutout tab can be completely removed, partially folded and locked or any other method which is convenient for manufacture. One advantages to this method is the prevention of reuse of the cartons as it is impossible to hide the removal of the tab. The cutout 13 is perforated on a quarter circular basis with the section adjacent the fold line between the handle 14 and the panel 38 also be perforated. The fold line 13A is scored to allow for easy folding.

Figure 2:
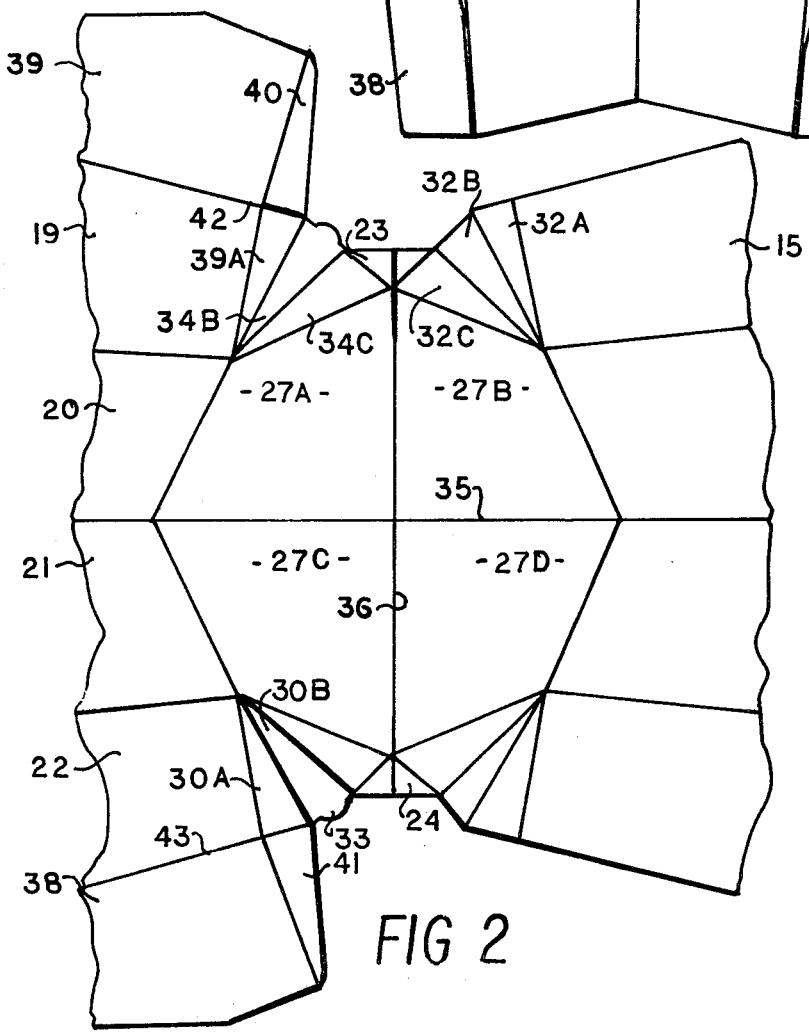
FIG. 2 is a plan view of the bottom of the blank of the preferred embodiment.

FIG. 2 shows the bottom portion of the unassembled blank of the preferred embodiment. The wall forming panels 15, 16, 17, 18, 19, 20, 21 and 22 are divided into two equal sized halves, 15, 16, 17, 18 and 19, 20, 21, 22. The panels 15–22 are of equal widths throughout their length with the inside ends angled to correspond to the bottom octagon 26 and webs **28*a*, 30*a*, 32*a* and 34*a*. The outer edge or periphery of the panels 15–22** can be straight, angled or in a decorative pattern corresponding to the contents or exterior picture as required by the aesthetics of the system.

The bottom octagon 26 is divided into four equal octagon sections **27*a*, 27*b*, 27*c* and 27*d* by fold lines 35 and 36. The fold lines 35 and 36** allow for the snap closure effect which is explained hereinafter.

Glue panels 38 and 39 lie next to the panels 19 and 22 with flaps 40 and 41 extending therefrom. The flaps 40 and 41 are connected by fold lines to webs **30*a* and 34*a*. The glue panels 38 and 39 are folded at time of manufacture at fold lines 42 and 43, placed over panels 15 and 18 and sealed by means well known in the prior art. The fold lines 42 and 43 must align with the outer edges of the panels 15 and 18 and the flaps 40 and 41 must align with webs 28*a* and 32*a***. The coordinated dimensioning of parts is critical for the container to assemble and open properly.

The following angles have been found to provide optium efficiency, however they can be varied depending upon the criticalities associated with various applications.

Angle A—58°
Angle B—22°
Angle C—36°
Angle D—72°
Angle E—173°
Angle F—18°
Angle G—18°
Angle H—72°
Angle I—93.5°

The interior angles of all webs must be identical so to allow the assembly or set-up process to take place.

Positioned between webs **30*c* and 26*c* and 32*c* and 34*c* is the lockwebs 23 and 24. The lock webs 23 and 24 are triangular shaped inserts, attached to the webs 26*c*, 30*c* and 32*c*, 34*c* by fold lines and is creased down the center by the continuation of fold line 36**.

Figure 3:
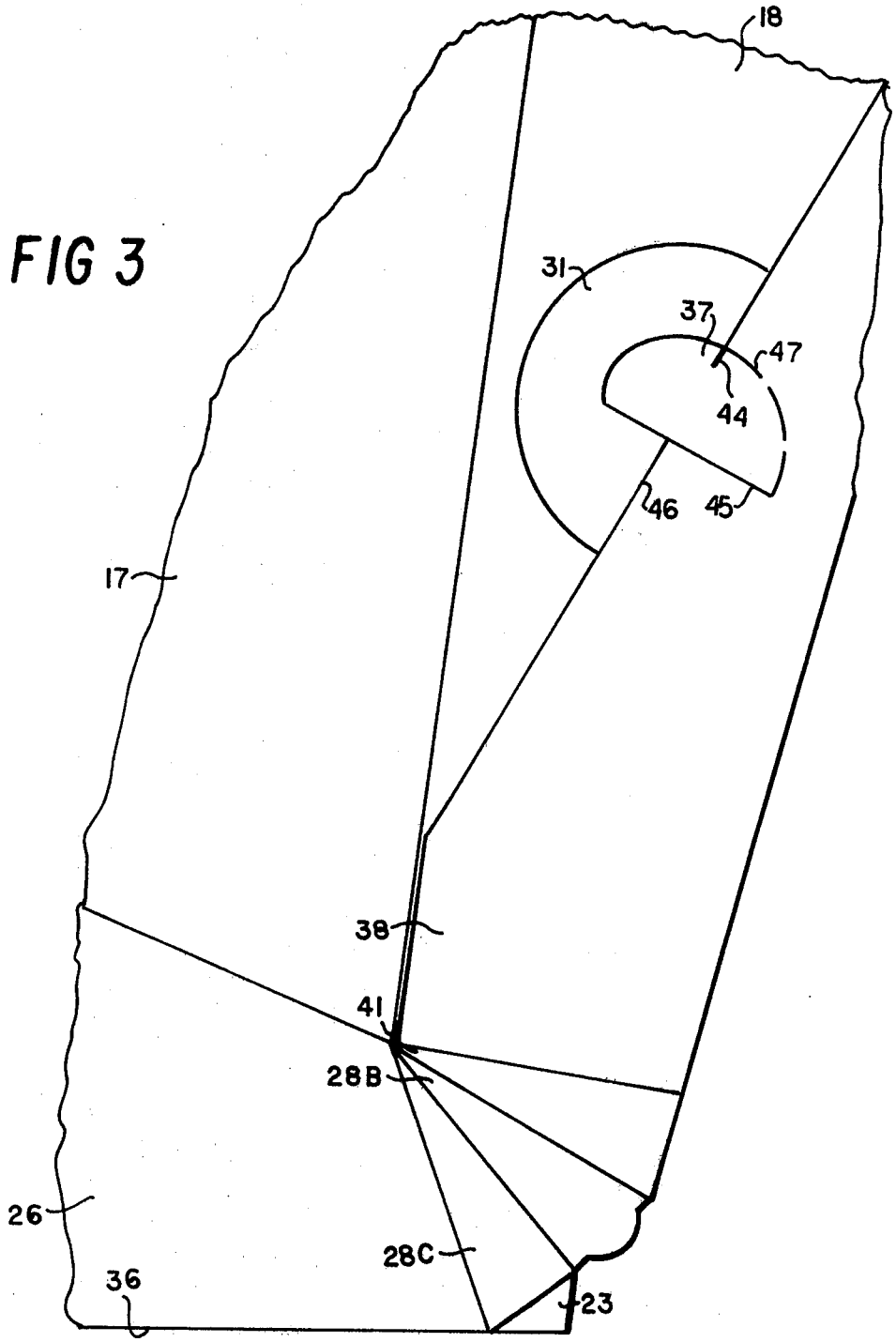
FIG. 3 is a fragmentary view of the container in the pre-set-up position.

FIG. 3 illustrates the bucket in the ready to assemble or set-up stage. The blank has been folded in half at fold line 36, aligning the panels 15–22. The glue flap 38 has been sealed to panel 18 along glue line 42 by means well known in the prior art. The flap 41 is shown overlying the web **28*a***.

An alternate embodiment of the handle configuration as shown in FIG. 1 is illustrated herein. The handle tab 37 is perforated in a semi-circular configuration, or a configuration similar thereto, with a portion thereof extending into panel 38. One radial line is utilized as a fold line 45. Tear line 47 is only partially perforated so that upon opening it is obvious the carton was in use and prevents reuse of the container. When the handle 31 is opened to extend outwardly from the container along fold line 46 a space is provided for the tab 37 to be folded down along fold line 45 with notch 44 locking onto the open section of the handle 31. The proporations of the cutout section should be such that the tab 37 when folded is sufficiently larger than the cutout section of the handle 31 so as to lock thereon through use of notch 44.

Figure 7A:
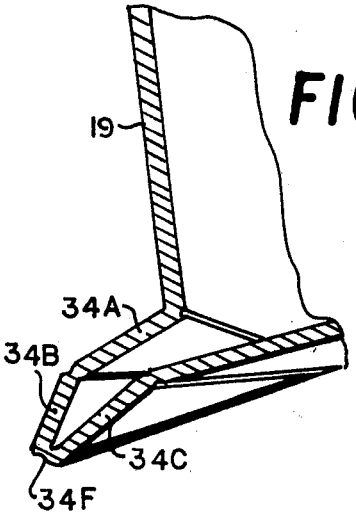
FIGS. 7A, 7B and 7C are fragmentary cross-sectional views showing the web mechanism during the set-up operation.

The bucket is ready to be opened. The bottom 26 is pushed upward toward the open end, creasing at fold lines 35 and 36 and forming a concave bottom. This action has forced the webs to fold at the fold lines **34*f* between webs 34*c* and 34*b* as illustrated in FIG. 7A. Tab 33 aids in forming a lock by interacting with the peripheral edge 32*p* of web 32*b***.

Figure 7B:
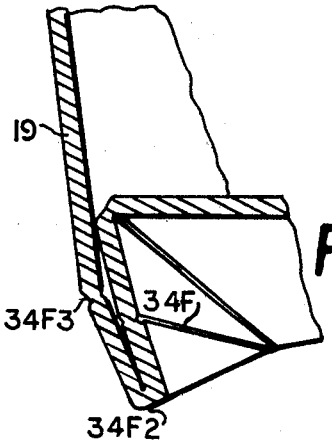

Pressure is then applied to the bottom 26 at the regions near the webs. This action forces the webs to straighten at the fold line **34*f* between webs 34*c* and 34*b* and fold at the fold line 34*f*2 between 34*b* and 34*a*, as illustrated in FIG. 7B. The web 34*a* is then folded over onto 34*b* at the fold line 34*f*3 between web 34*a* and panel 19**, creating the folded strength and rigidity obtainable in the instant invention.

The obtuse angle between the planes of the contiguous lock webs **34*c*** creates a distortion or force which precludes the reverse motion of the parts and serves to lock the various webs in place.

This action is also completed, in turn, with the other side of the bucket. Upon assembly, the bucket is rigid and leakproof due to the multiple folds of the webs and the resilient structure of the bottom 26.

Figure 4:
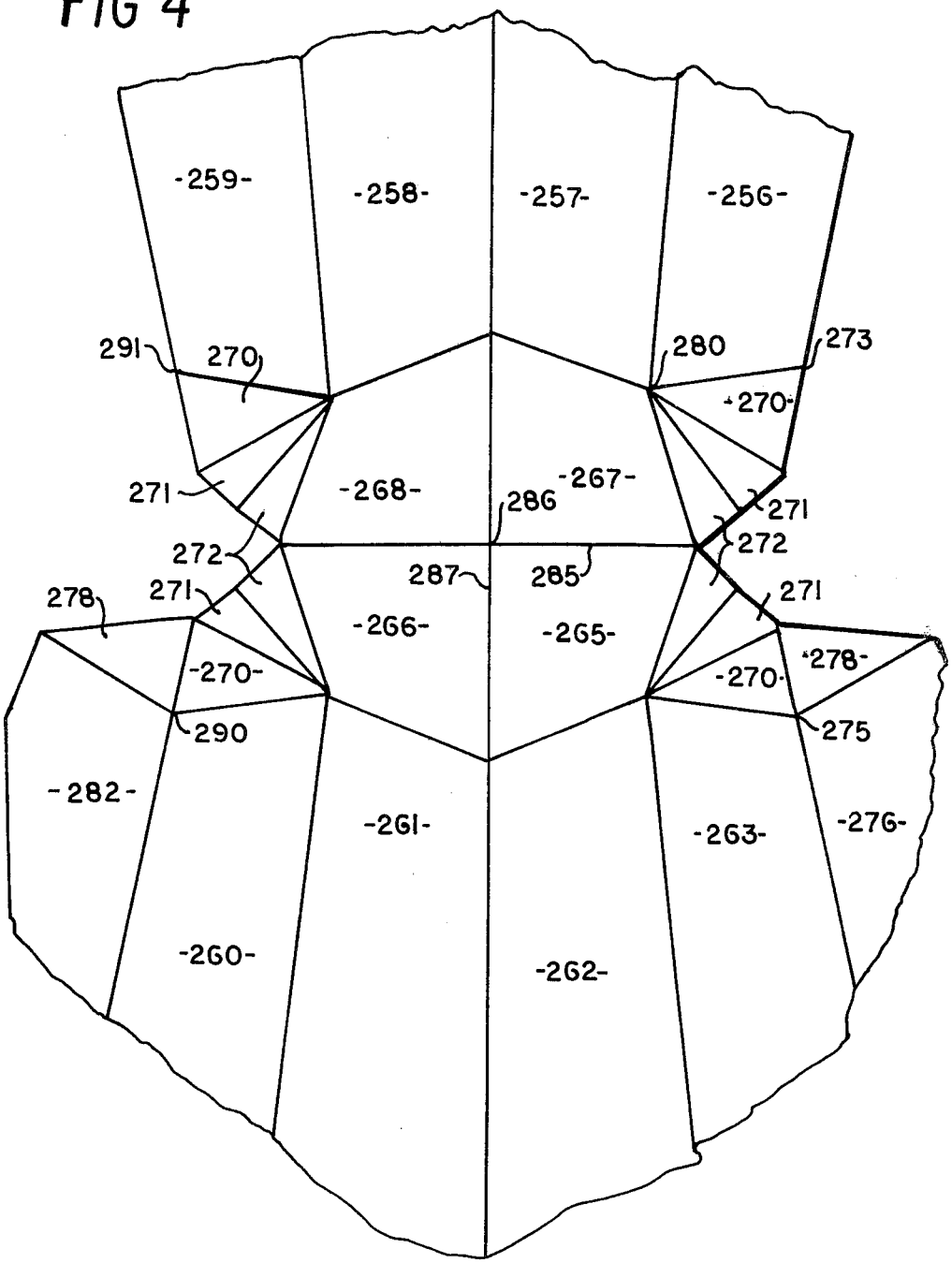
FIG. 4 is a plan view of the bottom of an alternate blank embodiment.

FIG. 4 illustrates an alternate embodiment of the instant invention, through illustration of the bottom portion of the blank. The side wall panels, typically trapezoidal, are numbered 256 through 263 inclusive. The single dark lines within the blank shown in FIG. 4 represent fold or crease lines, while the free edges of the blank are denoted by the limits of the light colored portion of the drawing. The bottom of the container consists primarily of four trapezoidal panels numbered 265 through 268, all being identical. Panel 265 is contiguous with panel 262; panel 266 is contiguous with panel 261; panel 267 is contiguous with panel 258; and panel 268 is contiguous with panel 257.

Between the panel 263 and panel 265 are interposed three triangular panels 270, 271 and 272, which have counterparts in the other four corners number similarly.

When the blank is glued together prior to the formation of the bottom, the corner of panel 256 identified by the numeral 273 is adjacent to the corner of panel 263 identified by the numeral 275. A glue and handle flap 267 is adapted partially to overlap the panel 256, and be glued or otherwise adhered thereto. Contiguous with the panel 276 is a further triangular panel 278 which is adapted to lie in juxtaposition with the triangular 270 contiguous with panel 256, such that the corner 279 of the panel 276 will coincide with the corner 280 of the panel 256. An identical arrangement is provided for another glue and handle flap 282 on the rightward side of FIG. 4. It is not necessary to explain again the way in which this side of the blank is fitted together.

When the glue flaps 276 and 282 have been secured in the manner indicated, the bottom, consisting of panels 265–268, will generally take the shape of a "roof" with the peak running along the line 285. By pressing downwardly on the center point 286 of the bottom, it is possible to "oil-can" the bottom so that it projects inwardly, and so that the primary fold runs along the line 287, which is at right angles to the line 285. At this point, the bottom of the container is only partly set up. The next step is to push the extreme ends of the line 285 inwardly, which will cause the triangles 271 and 272 to flip over and inwardly, until for each set of triangles, the triangles 271 and 272 lie in juxtaposition with the corresponding triangle 270, and such that the extreme end of the line 285 lies closely adjacent the location of the juxtaposed corners 279 and 280 previously described. At this point, it is merely a matter of pressing inwardly at the points 275 and 290, which are also points 273 and 291, and this will fold all of the composite triangles 270, 271 and 272 inwardly to lie down against the corresponding trapezoidal panels 265, 266, 267 and 268 respectively. This completes the setting up of the bottom of the box.

Figure 5:
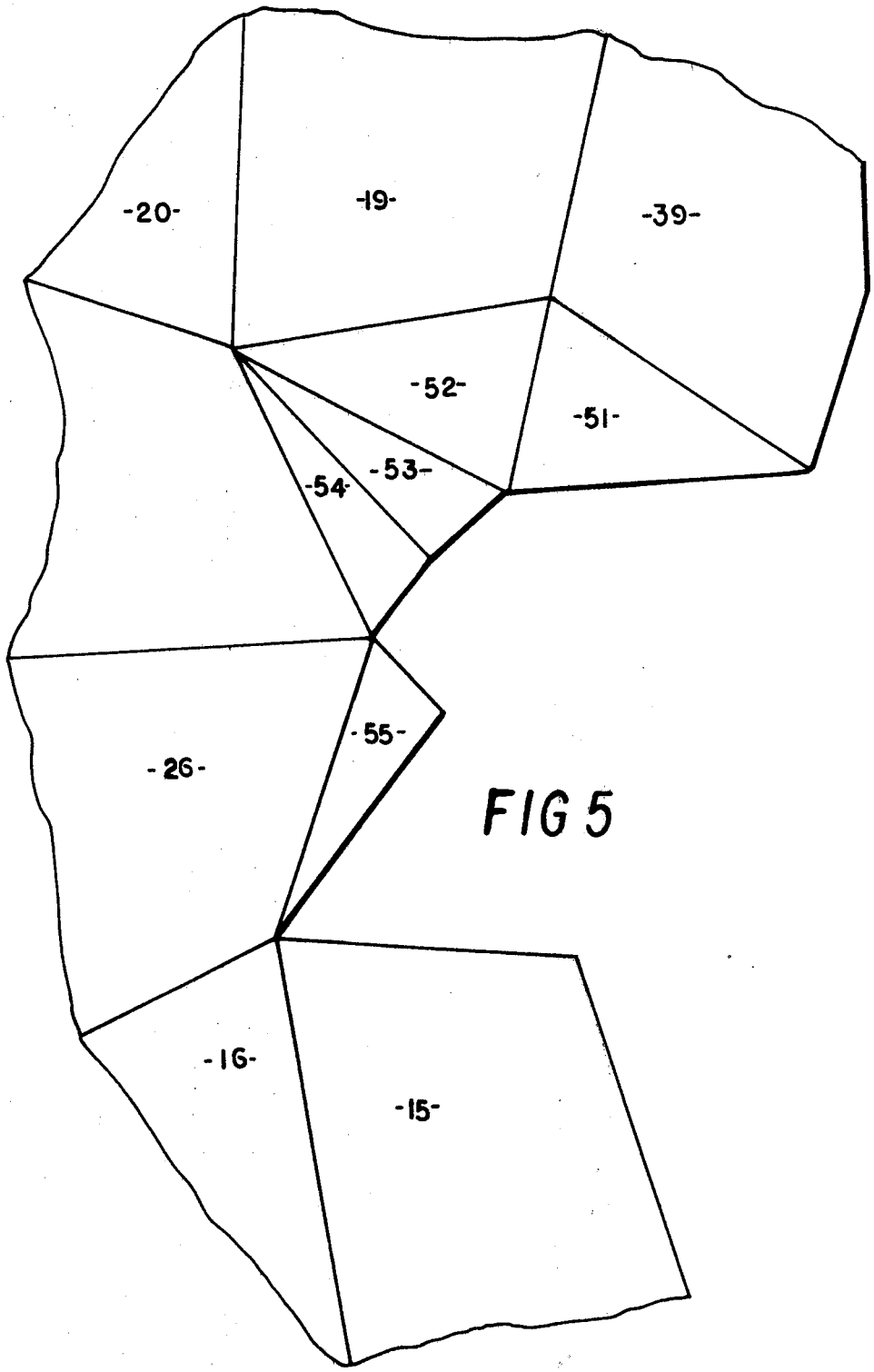
FIG. 5 is a plan view of the blank of an additional embodiment.

FIG. 5 shows an additional embodiment of the instant invention, again through incorporation of a partial of the bottom of the blank. In this embodiment, referred to as the half web flap style, the panels of the container 19, 20, 15, 16 and 39 are identical to those of the previous embodiments, as is the bottom octagon 26. The webs 51, 52, 53 and 54 of the instant embodiment are formed as those of the previous figures and will be assembled as stated. Web 55, however, is the only web on corresponding side of the blank. The webs **32*a* and 32*b*** have been omitted which allows for a quick, easy assembly of the bucket.

The use of a plurality of cooperating webs to lock the bottom serves two functions.

Figure 6:
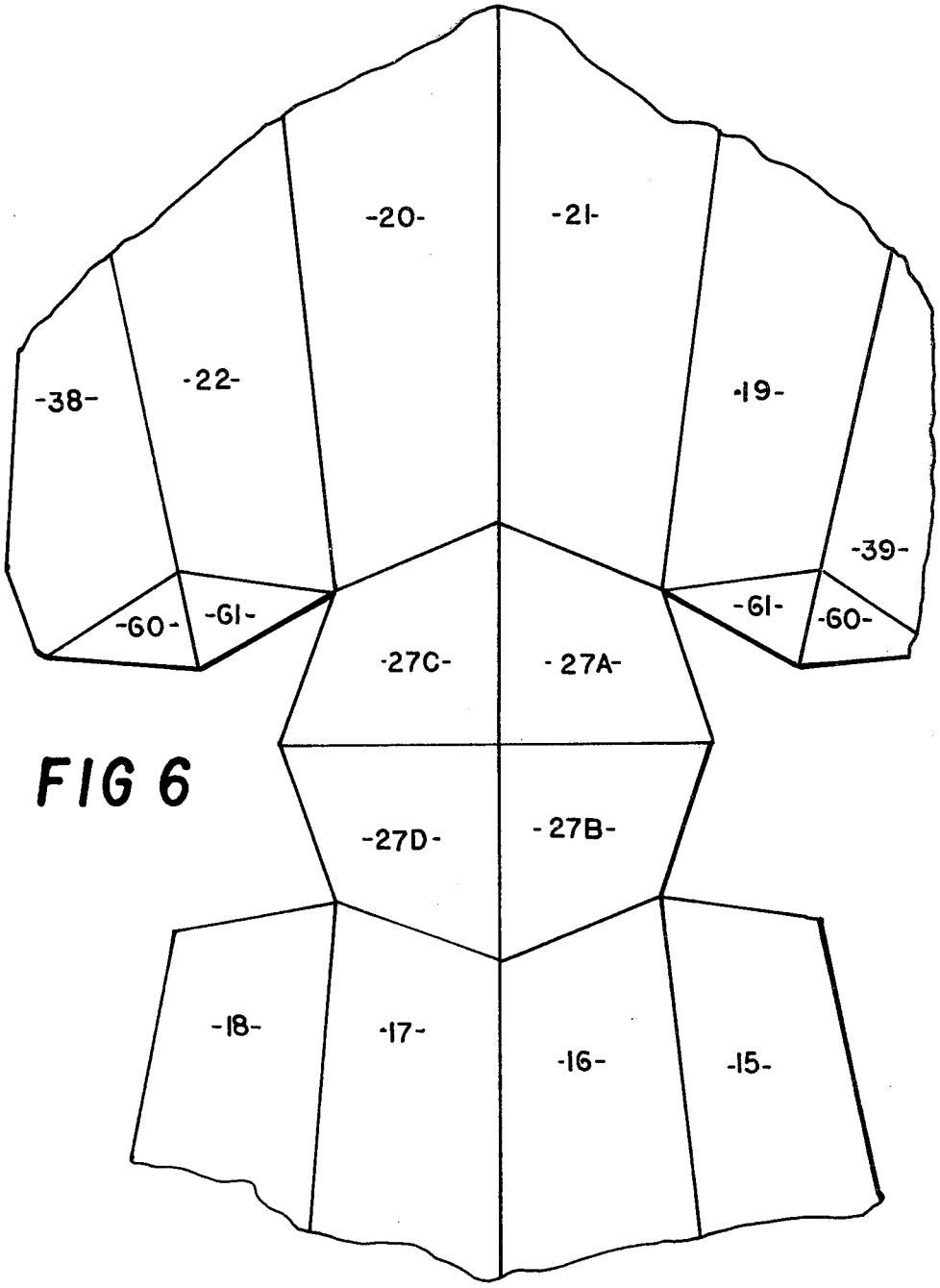
FIG. 6 is a plan view of the blank of another embodiment.

As illustrated in FIG. 6, the pair of adjacent webs 60 and 61 of FIG. 6 provide a shelf or support for the base panels 26.

The use of linking webs, **32*a*, 32*b* can serve to rigidify the support webs 60 and 61** or can be used in a more complex locking system. In the first noted system the use of a pair of webs facilitates the foldover operation, whereas in the second noted system, each web serves an independent function.

Figure 7C:
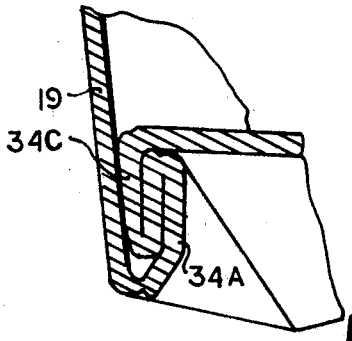

In FIGS. 7A, 7B and 7C, the rolling closure action sequence is shown and results in a form in which the base panel 26 is supported by the interconnected webs. Webs **32*c* and 32*c* are essential in the embodiments in which the base is not supported on a shelf like structure. In the set-up container, the webs 32*c* and 34*c* lie in plane parallel to the side panels 39 and 19 and are held in position by the support webs 34*a* and 40. Linking webs 34*b* and 32*b* serve as rigidifying structures. The support webs 32*a* and 40 are functionally almost identical since the end side panel 36 is glued in an overlying manner on the end panel 15 of the opposing set of side panels. The elimination of the support web 40 would weaken the locking structure by eliminating the connection between the support web 34*a* and the cooperating support web 32*a* and would leave an extended opening between the interior of the container and the exterior of the container. In some instances where it is desired to further enhance the water-tight integrity of the structure, sealing or locking webs 23 and 24** can be employed. Each sealing web serves to eliminate direct access from the interior to the exterior of the container.

Figure 8A:
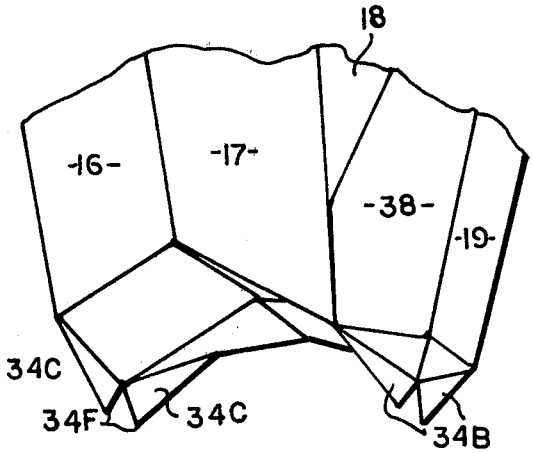
FIGS. 8A and 8B are side views of the assembly of the bottom of the container.
Figure 8B:
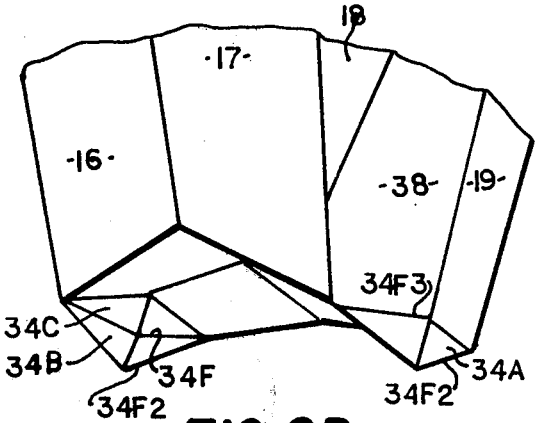

FIGS. 8A and 8B are alternate side views of the folding procedure described in realtion to FIGS. 7A and 7B. The completed fold over of FIG. 7C is of the configuration of FIG. 1.

The blank design must be such that it is readily glued and folded on commercially available equipment with no more than minor adjustments to the equipment. Thus, the blank has aspects of criticality independent of the structure of the container. For example, the glue flaps need not be at opposite ends of the same set of side panels. However, during manufacture of the container in knock-down form, gluing would require either special equipment or two stages of gluing.

Although an octagonal structure is preferred, other structural configurations can be used.

The preferred octagonal configuration uses a pair of side panels to form the bottom locking mechanism as illustrated in FIG. 7. By way of contrast, a configuration employing a trio of side panels does not distort and twist the paperboard as effectively as the duet system.

Figure 9:
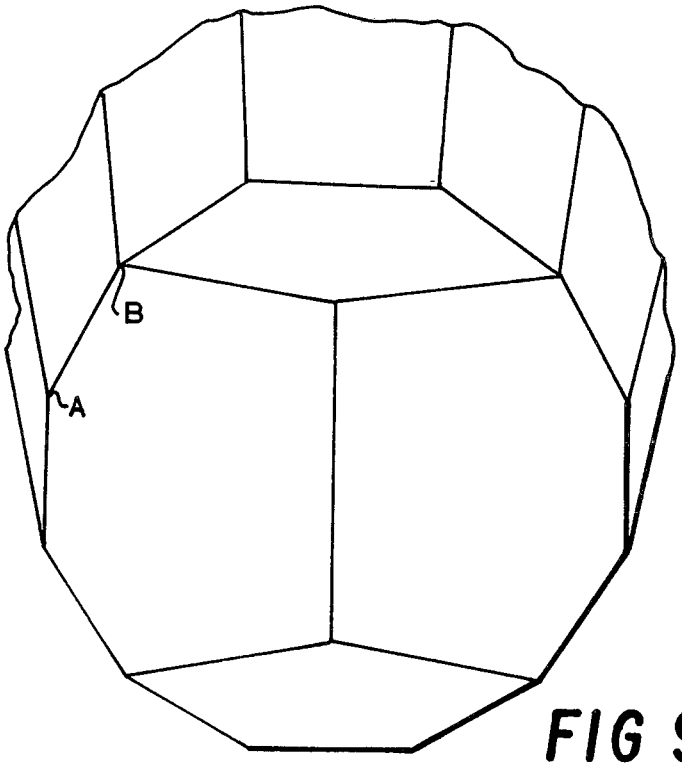
FIG. 9 is an alternate embodiment of the container of the instant invention; and, FIG. 10 is an additional alternate embodiment of the container of the instant invention.
Figure 10:
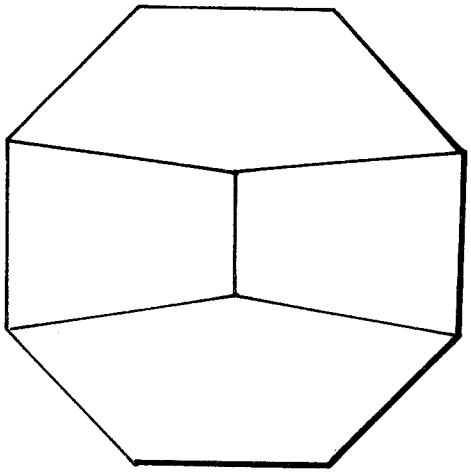

The modifications of FIG. 9, the FIG. 10, employ a pair of triple side panels and single side panels respectively. The pair of single side panels form provides virtually no structural reinforcement, while the triple side panel form provides less rigidification than the dual side panel form.

In the triple side panel modification, structural rigidity can be varied by varying the angles A and B between the base panel fold lines and the side panel side wall fold lines, with rigidity increase inversely with angle B and directly with angle A.

It should also be noted that the structures of FIGS. 9 and 10 do not lend themselves to convenient shipping in flat form and decrease the economic advantages of the system over rigid truncated conical containers or buckets as they are commonly called.

The proportions of the container, that is height relative to width, and width of open top relative to bottom width, as well as the number of and relative width of panels are features having aesthetic importance only and are not features of the instant invention. Similarly, angle change can be made relative to the aesthetic desires, particularly in regard to the angles of the polygons which do not have to be exactly equal to more than one opposite angle but must be sufficient to cause the base panel to be concave when set-up.

What is claimed is:

1. A blank for forming a container capable of being rapidly set-up into a self-supporting structure, comprising, a polygonal base panel having n sides, wherein n is at least eight, at least n+2 side panels, each of side panels being separated from at least one other side panel by a fold line, no more than n−4 of said side panels being separated from said base panel by a fold line which forms a peripheral side of said base member, said side panels being in a first contiguous group and a second contiguous group, two end members of said side panels being glue flaps, said first contiguous group including a first set of side panels and said second contiguous group including a second set of side panels, each of said first set and said second set of side panels being panels which do not share a fold line with said base panels, a first set of support web panels, said first set of support web panels sharing a fold line with at least one panel of said first set of side panels, and each panel of said first set of support web panels sharing a common fold line with each other, a second set of support web panels, said second set of support web panels sharing a fold line with at least one panel of said second set of side panels, and each panel of said second set of support web panels sharing a common fold line with each other.

2. The structure of claim 1, wherein said polygon is an octagon, and has two intersecting foldlines which divide said polygonal base into four equal sections, and said structure has two essentially mirror images halves.

3. The structure of claim 2, wherein said first set of side panels and said second set of side panels comprise two side panels and are at opposite ends of said first contiguous group of side panels.

4. The structure of claim 3, further comprising a locking web carried by each end side panel of said second contiguous group of side panels and divided therefrom by a fold line.

5. The structure of claim 3, wherein a member of each of said set of support panels is linked to a peripheral side of said polygonal base by at least one linking web.

6. The structure of claim 3, further comprising a locking web carried by each side of two opposite pairs of sides of said polygonal base panel.

7. The structure of claim 6, wherein at least one locking web of each of said two opposite pairs of sides are linked by a linking web to a side panel which does not share a common fold line with said base panel.

8. The structure of claim 6, wherein each locking web is linking by at least one linking web to a side panel which does not share a common fold line with said polygonal base panel.

9. The structure of claim 8, wherein each pair of said locking webs has a sealing web contiguous thereto and separated therefrom by a fold line, said sealing web having a fold line which divides said sealing web into two halves.

10. The structure of claim 8, wherein each of two linking webs have a locking tab extending outwardly from a peripheral edge.

11. The structure of claim 8, wherein each of said support webs, linking webs and locking webs are essentially triangular in configuration.

12. The structure of claim 2, wherein each half has two side panels contiguous with said polygonal base, two end side panels not contiguous with said polygonal base and a glue flap side panel contiguous with one of said two end side panels.

13. The structure of claim 12, wherein said glue flap side panel has a handle forming region contiguous with one outer side edge and separated therefrom by a fold line.

14. A self supporting container formed from the blank of claim 2, wherein each of two glue flaps have been folded over and adhered to an end side panel to form a unitary structure having two essentially identical halves with said polygonal base panel lying a plane which is approximately perpendicular to the planes of the side panel, said support webs lying in a plane substantially parallel to and adjacent to the proximate region of said polygonal base in supporting relationship thereto.

15. The structure of claim 12 wherein in each set of support webs said common fold line is at approximately a right angle with the fold line shared by one member of said set of side panels and a support web.

16. The structure of claim 11, wherein said triangular web configurations are substantially equal in size and angles.

17. A self supporting container formed from the blank of claim 8, wherein each of two glue flaps have been folded over and adhered to an end side panel to form a unitary structure having two essentially identical halves with said polygonal base panel lying in a plane which is approximately perpendicular to the planes of said side panels, each of said support webs being folded inwardly such that each linking web is in firm contact with its corresponding locking web, which in turn is firmly against an interior region of a side panel.

18. The self supporting container of claim 17, wherein each pair of said locking webs has a sealing web contiguous thereto and separated there from by a fold line, said sealing web having a fold line which divides said sealing web into two halves, said sealing webs providing fluid tight integrity.

19. The self supporting container of claim 18, wherein a locking tab extends from a peripheral edge of at least two linking webs.

20. The self supporting container of claim 19, wherein said sealing webs have a first side coextensive with the peripheral edge of one locking web and a second side coextensive with peripheral edge of a second locking web adjacent to said first locking web, and a third side extending from the intersection of the fold line shared by said linking web and said locking web and the peripheral edge of said linking web and locking web.

21. The self supporting container of claim 20, further comprising a handle means and tear tab for locking said handle means and preventing container reuse and/or revealing a prize, wherein said handle means is a flap panel extending from a peripheral edge of a glue flap panel and separated therefrom by a handle fold line, said tear tab having a first peripheral edge which is a tear tab fold line shared with said glue flap panel and extending at substantially a right angle from said handle fold line, a second peripheral edge extending from said tear tab fold line intersection with said handle fold line to the opposite end of said tear tab fold line, the region of said peripheral edge contained in said glue flap panel being incompletely perforated, said tear tab having a maximum width from the intersection of said handle fold line and said tear tab fold line which is substantially greater than the distance from said intersection to the interior edge of said handle which is formed by removal of said tear tab from said handle means flap panel, and a notch in said tear tab to receive and lock in place said handle means, whereby, a movement of said tear tab to its position at essentially right angles to said handle means flap panel requires the tear of the uncut portion of the peripheral edge of said tear tab and serves to indicate that the container has been used.

22. A preset-up container capable of being set-up into a self supporting container, comprising the blank of claim 2, wherein the blank is folded over on itself about a fold line which divides the octagonal base in half, such that a first group of contiguous side panels overlie a second group of contiguous side panels and wherein end glue flap panels of one group of contiguous side panels are folded over and adhered to corresponding end panels of the other group of contiguous side panels.

23. The method of setting up the self supporting container of claim 22, comprising the steps of:

(a) pressing the folded outer side edges toward each other and pushing the folded bottom edge toward the container top causing the container to open and produce a concave curvature of the base panel;

(b) pressing the base panel at the two opposite regions proximate the webs, and applying pressure whereby the web sections roll over first about the fold line common to said locking web and linking web and then about the fold line common to the linking web and said support web; and (c) folding over the support web about said fold line common to the side panels and said support webs until said linking web is firmly lying against said locking web.

24. A blank for forming a container capable of being rapidly set-up into a self-supporting structure, comprising, an octagonal base panel, said octagonal base having two intersecting foldlines which divide said base into four equal sections and said structure into two essentially mirror images halves, at least ten side panels, each of said side panels being separated from at least one other side panel by a fold line, no more than four of said side panels being separated from said base panel by a fold line which forms a peripheral side of said base member, said side panels being in a first contiguous group and a second contiguous group, two end members of said side panels being glue flaps, said first contiguous group including a first set of side panels and said second contiguous group including a second set of side panels, each of said first set and said second set of side panels being panels which do not share a fold line with said base panels, a first set of support webs sharing a common fold line with each other and each support web panel sharing a fold line with one member of said first set of side panels, and a second set of support webs sharing a common fold line with each other and each shpport web panel sharing a fold line with one member of said second set of side panels.

* * * * *